US006134908A

United States Patent [19]

Brunner et al.

[11] Patent Number: 6,134,908

[45] Date of Patent: Oct. 24, 2000

[54] ICE MAKING APPARATUS WITH IMPROVED EXTRUSION NOZZLE

[75] Inventors: Roger Patrick Brunner, Wind Gap; Jack Richard Miller, Nazareth, both of Pa.

[73] Assignee: Follett Corporation, Easton, Pa.

[21] Appl. No.: 09/168,260

[22] Filed: Oct. 8, 1998

[51] Int. Cl.[7] ..... F25C 1/14; F25C 5/14

[52] U.S. Cl. ..... 62/354; 425/376.1

[58] Field of Search ..... 62/354; 425/376.1

[56] References Cited

U.S. PATENT DOCUMENTS

| | | | |
|---|---|---|---|
| 2,783,499 | 3/1957 | Billen | 425/376.1 |
| 3,371,505 | 3/1968 | Raver et al. | 62/354 |
| 3,769,809 | 11/1973 | Robinson et al. | 62/354 |
| 3,893,796 | 7/1975 | Korostoff et al. | 425/376.1 |
| 3,913,343 | 10/1975 | Rowland | 62/137 |
| 3,937,365 | 2/1976 | Shelley et al. | 222/241 |
| 4,198,831 | 4/1980 | Barnard et al. | 62/354 |
| 4,249,877 | 2/1981 | Machen | 425/376.1 |
| 4,429,551 | 2/1984 | Hizume | 62/354 |
| 4,497,184 | 2/1985 | Utter et al. | 62/354 |
| 4,533,310 | 8/1985 | Spinner | 425/376 R |
| 4,732,301 | 3/1988 | Tobias et al. | 222/203 |
| 4,817,827 | 4/1989 | Kito et al. | 222/238 |
| 4,942,983 | 7/1990 | Bradbury | 222/238 |

*Primary Examiner*—William E. Tapolcai
*Attorney, Agent, or Firm*—Paul & Paul

[57] ABSTRACT

An auger-type ice maker comprises a generally cylindrical-walled freezing chamber, a rotatable ice auger within the chamber, and a compacting head whereby ice formed in the freezing chamber is transferred by rotation of the auger into the compacting head and discharged therefrom via a nozzle. The nozzle is provided with an annular water-receiving canal for receiving water squeezed from ice as it compressed while passing through a converging nozzle. The configuration of the converging nozzle is arcuate, and is defined by a surface of revolution that is a frustum of a radius-defined convex conical passageway.

13 Claims, 5 Drawing Sheets

ICE MAKING APPARATUS WITH IMPROVED EXTRUSION NOZZLE

BACKGROUND OF THE INVENTION

This invention relates to ice making apparatus to be used in a commercial setting, most particularly ice making apparatus of the auger-type, which apparatus produces flaked or chipped ice. Ice is formed by water freezing on the inner wall of a hollow cylindrical freezing chamber. A rotatable ice auger, sized to enable the scraping of ice off the inner surface of the freezing chamber, conveys the flaked ice toward the axial end of the freezing chamber whereby the flaked ice is compressed into a rigid mass of ice which is subsequently severed into discrete, generally uniform nuggets of ice.

As nuggets of ice are formed in the compression nozzle at the upper end of the auger-type ice making apparatus, water molecules that contain high levels of dissolved solids due to the natural extraction of impurities during the freezing process, tend to aggregate in the nuggets, as trapped pockets of water. These pockets of water will, over time, cause the nuggets to degrade from within, and ultimately the nugget structure fails. Ice nuggets with inferior structure are often difficult to automatically dispense from a container, because they tend to crumble under the force of agitation and dispensing mechanisms, especially as they age in a bin or storage hopper.

Additionally, commercial uses of ice nuggets tend to require the delivery of the nuggets to locations in commercial establishments that are increasingly remote from the situs of the ice making apparatus, as is increasingly the case in supermarkets, fast-food establishments, beverage lounges and other places where the locations where the ice nuggets are to be use are not convenient locations for the making of the ice. Thus, with the desire to deliver ice nuggets over increasingly long distances, it becomes increasingly important that the nuggets remain intact, and not separate into a plurality of components, releasing water as they do.

The present invention is directed to providing an ice making apparatus with a discharge nozzle that is increasingly effective in providing a high ratio of ice to water per volume of nugget.

SUMMARY OF THE INVENTION

The present invention provides an ice making apparatus in which the ice discharge nozzle is configured to provide a high compressive force component for compressing the ice nugget transversely, without requiring any significant increase in extrusion force, in order to avoid increasing the forces on the auger and the motor which drives the auger.

In doing so, the nozzle of the present invention provides an arcuate, and preferably radius-defined convex conical passageway as distinguished from a true frusto-conically tapered interior configuration for the nozzle, whereby the gradual reduction in inner diameter of the nozzle through which the being-formed nugget passes, is defined by an arcurate configuration.

The present invention also provides a means of water evacuation from the nozzle during nugget formation as ice leaves the ice making apparatus, in providing a drain port for water being squeezed out of water pockets, to facilitate evacuation of water from the nozzle, as well as preferably a collection zone or canal for receiving the water. Additionally, a vent may be provided, associated with the drain port, to facilitate free drainage of water.

Accordingly, it is an object of this invention to provide a novel nozzle configuration that facilitates increased compression forces without requiring any significant increase in extrusion forces, or any significant increase in the reaction forces on the auger, motor, or other components as a result of providing the increased compression forces for the nuggets.

It is a further object of this invention to provide a novel nozzle configuration that facilitates increased nugget density, or increased ratio of ice to water per volume of nugget.

It is a further object of this invention to provide a means for evacuating water from nuggets during their formation, in order to reduce the water component of nuggets of ice.

It is a further object of this invention to accomplish the provision of more dense nuggets of ice, by various combinations of aforementioned features.

It is a further object of this invention to facilitate delivery of ice nuggets over greater lengths, in ice delivery systems, by providing nuggets of increased ice density.

Other objects and advantages of the present invention will be apparent from a reading of the following brief descriptions of the drawing figures, detailed descriptions of the preferred embodiments and the appended claims.

BRIEF DESCRIPTIONS OF THE DRAWING FIGURES

DESCRIPTIONS OF THE PREFERRED EMBODIMENTS

Figure 1:
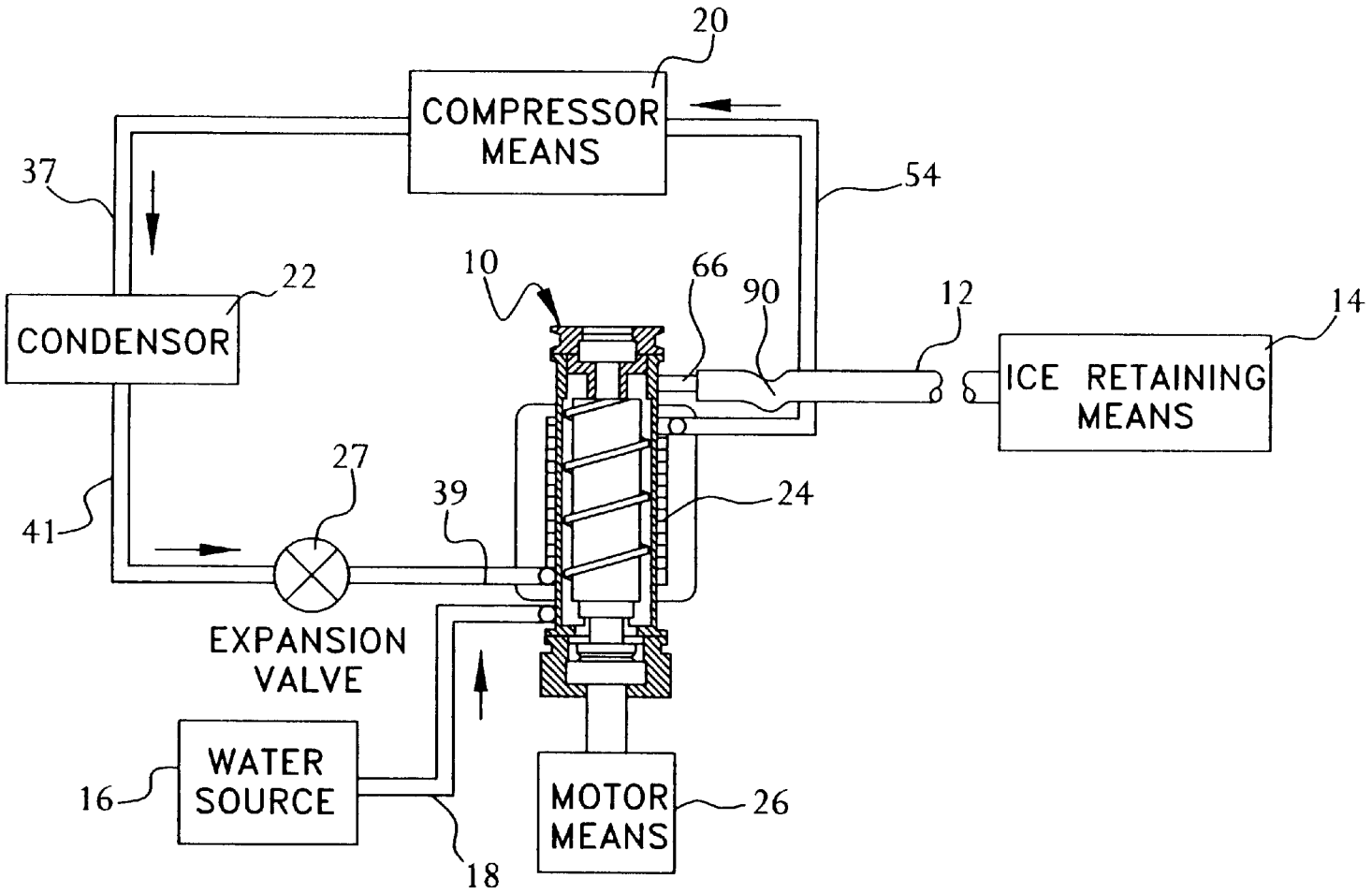
FIG. 1 is a schematic diagram of the ice making apparatus according to the present invention, and a system for delivering nuggets of ice thus formed over long distances, to an ice retaining means.
Figure 2:
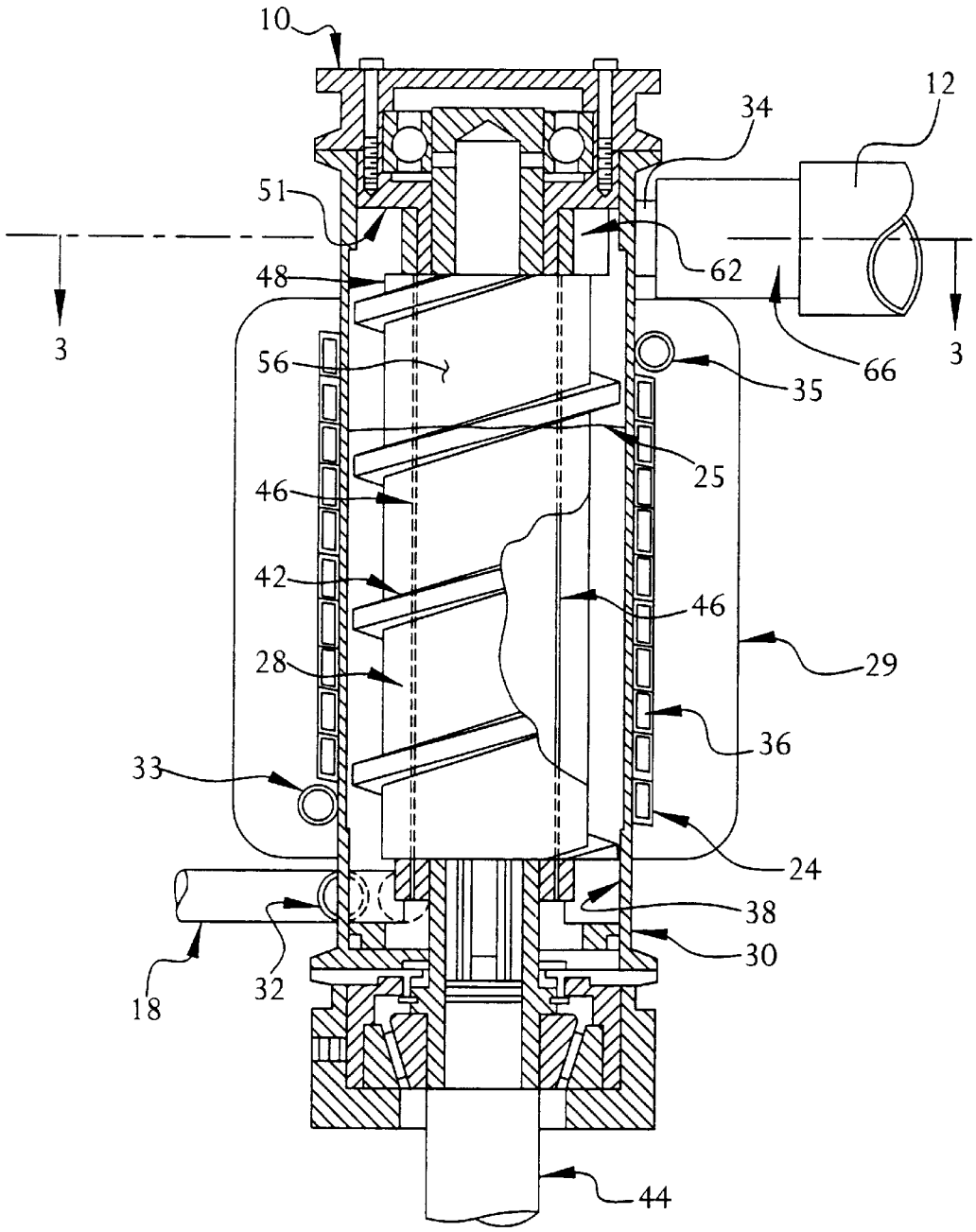
FIG. 2 is a vertical sectional view, partially broken away, of the auger-type ice generating apparatus embodied in the system shown in FIG. 1, generally along the line 2—2 of FIG. 3.

Referring now to the drawings in detail, wherein like reference numerals indicate like elements throughout the several views, there is shown in FIGS. 1 and 2 an ice making apparatus in accordance with one preferred embodiment of the present invention. The illustrative apparatus is shown generally comprising an auger-type ice generating apparatus 10, with a motor means 26 to drive the ice generation apparatus 10, an input line for water 18 from a water source 16, which water is to frozen in the apparatus 10, an outlet delivery line 12 for delivery of nuggets of ice to an ice retaining means 14, a refrigeration means comprising a compressor means 20, a condenser means 22, an expansion valve 27, and an evaporator 24 to supply refrigeration to the ice generating means 10. The compressor means, condenser means, evaporator and expansion valve that compose the refrigeration means can be as disclosed in U.S. Pat. Nos. 3,126,719 or 3,371,505 or of any other type. The retention means can be as shown in U.S. Pat. No. 5,211,030 or of any other types.

It will be understood that the ice retaining means 14 may be disposed at location that is remote from the ice generating apparatus 10, and that the delivery line 12 is shown broken, to indicate that the length or span of line 12 may be substantially long to accommodate delivery of ice formed in the ice generating apparatus 10 to an ice retaining means 14 a considerable distance away from the generating means 10.

In operation of the ice maker according to the present invention, conventional refrigerant under pressure is sent from the compressor means 20 via line 37 to the condenser means 22. The refrigerant is thereafter liquefied within the condenser means 22 and then passed via line 41 through an expansion valve 27 to the evaporator 24 via line 39. Evaporator 24, which completely surrounds the ice making machine 10, boils the liquid refrigerant under low pressure to extract heat from, and accordingly cool, the generally cylindrical ice freezing chamber 30. Evaporator 24 additionally comprises an evaporator cover 29 which serves as an insulator and protective cover. Water is supplied to the cylindrical freezing chamber 30, which houses the ice auger 28, from a water source 16 through water input line 18. A constant level of water 25 is maintained in the freezing chamber. Water freezes on the inner wall 38 of the freezing chamber 30 and is scrapped off by means of the ice auger 28.

The ice generating apparatus 10 according to the present invention is shown in greater detail in FIG. 2. The auger 28 is disposed vertically in the interior of the freezing chamber 30 and is driven by drive shaft 44. Actuation of the motor means 26 results in a rotation of the auger 28 which causes ice to be scrapped off the inner wall 38 of the freezing chamber 30 in flaked form. The ice generating apparatus 10 includes a water inlet 32, formed on its lower end for receiving water from the inlet 18, and ice discharge 34, formed on the upper end for delivering ice to the delivery line 12 after being compressed in compression nozzle 66. Tubing 36 is also included, wrapped a plurality of times around the freezing chamber 30 which defines the aforementioned evaporator 24. Evaporator 24 includes an inlet 33 for receiving the refrigerant from the expansion valve 27, and refrigerant vapor is passed out through an outlet 35, into outlet line 54, where, as shown in FIG. 1, it is carried back to the compressor means 20. The refrigerant extracts heat from the ice generating apparatus 10 though the walls of freezing chamber 30 as it passes through the evaporator 24. This causes some of the water contained within the freezing chamber 30 to freeze along the inner wall 38.

Auger 28 includes at least one helical flight scraper 42 extending outwardly from the auger surface 56, in close proximity to the inner wall 38 of the freezing chamber 30. The drive-shaft 44 connects to the motor means 26, extending axially through the auger 28. Accordingly, as the auger 28 is rotated, the scraper flight 42 shaves the ice formed on the inside walls 38, carrying it axially upwardly, in the form of slush, to be compacted against an annular compacting head 51.

Axial grooves 46, preferably six in number, guide the column and reduce rotation of the column of ice created in the ice generating apparatus 10 by the rotation of auger 28. The upper surface of the auger 28 has a knurled annular surface 48, like the radial groove knurling shown in FIG. 3, for example, although knurling of other types such as hatching or the like (not shown) may alternatively be employed. The knurled annular surface 48, whichever form it may take, is disposed spaced below the annular compacting head 51 and grips the ice to guide the ice though ice discharge 34. The resistance to rotation caused by the rifling or axial grooves 46 allows for higher compressive forces on the ice, and in combination with the knurled annular surface 48 or the like on the upper surface of the auger 28, aids in the discharge of compressed ice of higher quality which is denser, clearer, and more uniform.

Figure 3:
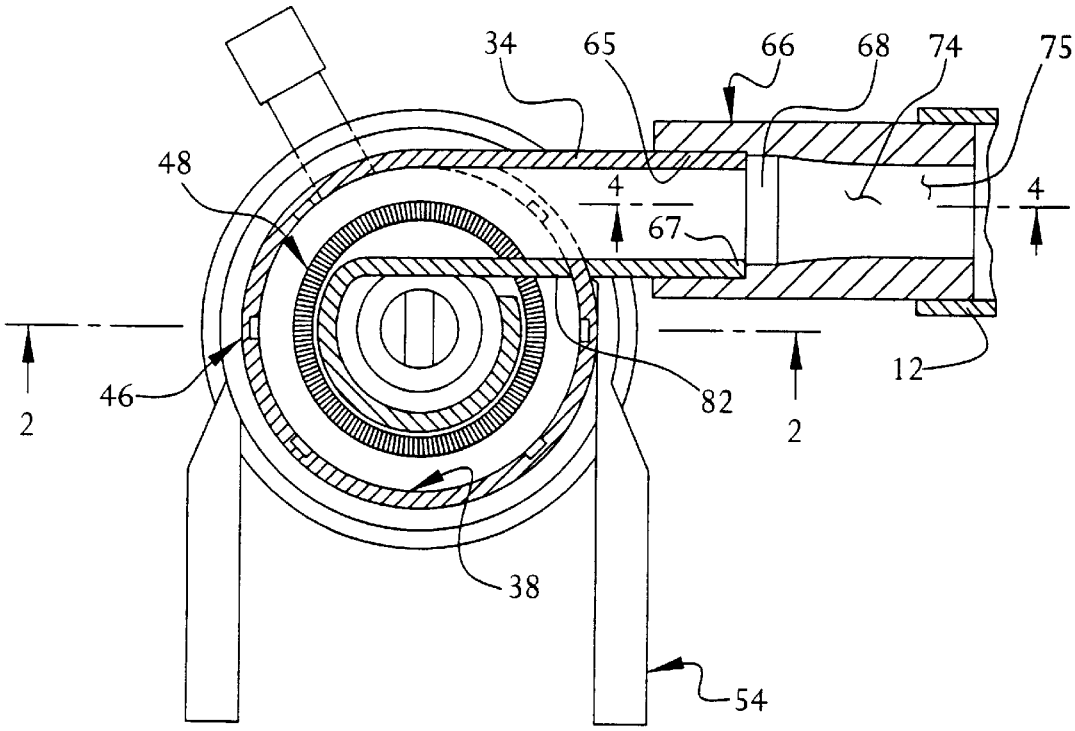
FIG. 3 is a transverse cross-sectional view of the apparatus of FIG. 2, taken generally along the line 3—3 of FIG. 2, with the evaporator not shown, but wherein the novel nozzle of this invention is illustrated in horizontal transverse section.
Figure 4:
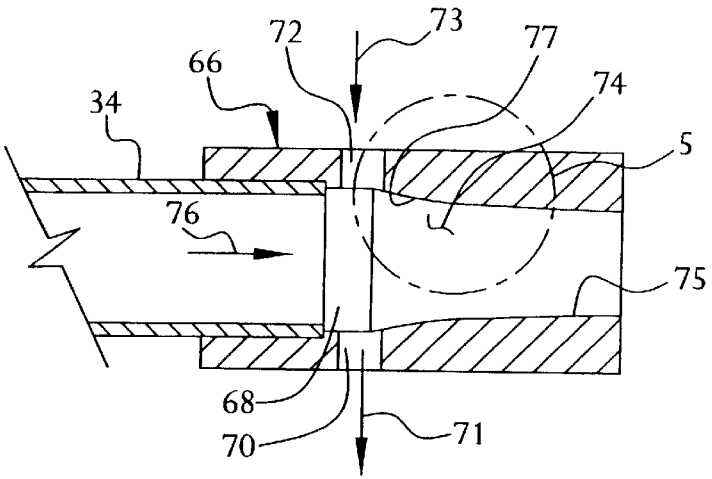
FIG. 4 is an enlarged fragmentary vertical sectional view, taken through the ice discharge duct and ice discharge nozzle of this invention, taken generally along the line 4—4 of FIG. 3.

With reference now to FIGS. 3 and 4, in particular, it will be seen that the ice discharge 34 has its outer end in engagement within a cylindrical bore 65 of a nozzle 66 and terminates at an end wall 67 therein. Beyond the end wall 67 is an annular canal 68 for receiving water compressed from the ice as it goes through the nozzle 66 and for delivery of such water out a drain port 70, downwardly, in the direction of arrow 71, to be returned to the freezing chamber 30, or to discharge, as desired, via a suitable water delivery line (not shown).

To facilitate drainage of water from the annular canal 68 through the drain port 70, there is provided an air vent 72, for receiving air therethrough in the direction of arrow 73, in order to ensure free drainage of water from the nozzle 66 after it is compressed out of water pockets in the ice, during the ice compression stage in nozzle 66.

Figure 5:
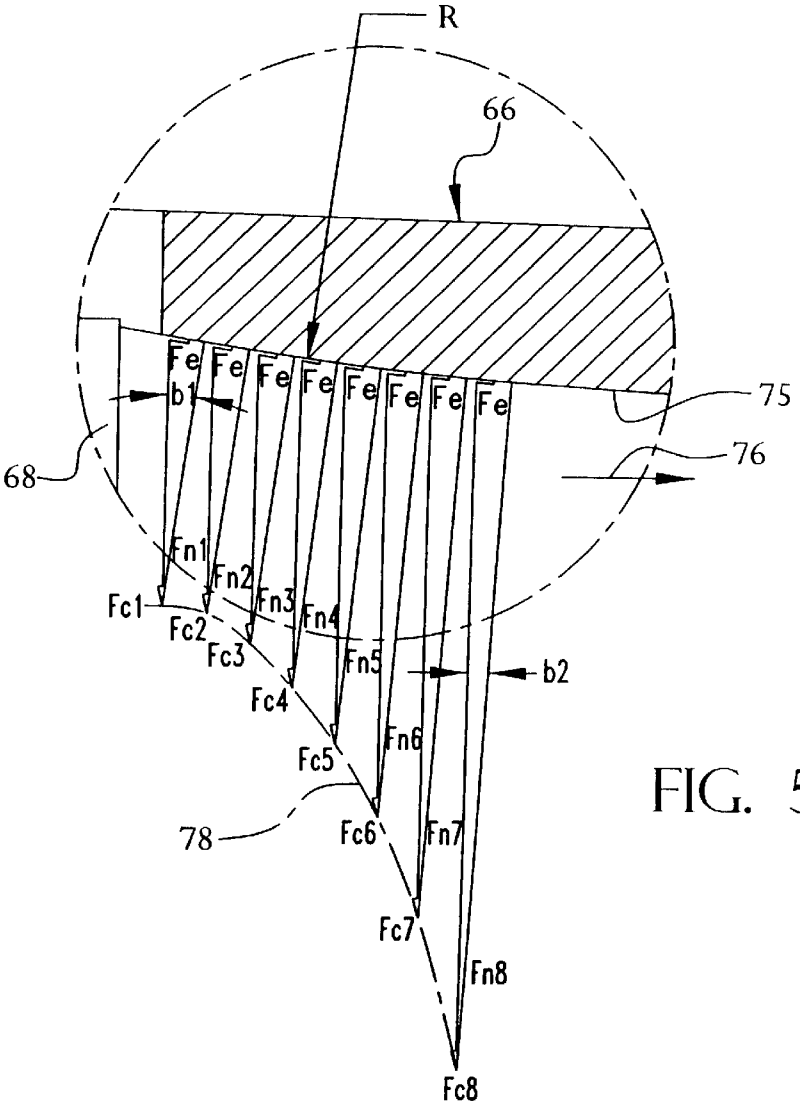
FIG. 5 is a further enlarged fragmentary vertical sectional view, of the area of detail 5 of FIG. 4, showing force distribution lines.

With reference to FIG. 5 it will be seen that the detail 5 of FIG. 4 illustrates a compression zone 74 in the nozzle 66, between the annular canal 68 and a cylindrically configured discharge zone 75 at the right end of the nozzle. Ice moving rightwardly as shown in FIG. 4, in the direction of the arrow 76, thus enters the compression zone 74, which zone 74 is of progressively decreasing cross-sectional area. The inner surface 77 of the compression zone 74 is comprised of an acruate surface of revolution that is a frustum of a convergent convex conical passage, as seen by ice passing through the zone 74, in that the configuration of said surface 77, between said canal 68 and the cylindrically configured exit 75 of the nozzle 66, is defined by a radius R, as shown in FIG. 5. A surface of revolution 77 that is formed by a radius R as shown in FIG. 5, to converge in the direction of arrow 76 and to be convex as seen by ice passing through the zone 74, is herein defined to be a "radius-defined convex conical passageway".

With reference to FIG. 5, it will be seen that a force gradient is illustrated for ice being compressed to squeeze water out of it, as the ice passes through the nozzle 66 in direction the of the arrow 76. In this force gradient $F_c$ is defined as the extrusion force reaction on the "X" axis; namely, in the direction opposite to that of the arrow 76, which represents the reaction force experienced on other components as ice is pushed through the nozzle 66 in the direction of the arrow 76. That is, the forces imposed on the auger, the motor, etc. are the reaction forces experienced from pushing ice through the nozzle 66.

In FIG. 5 the forces normal to the various contact points of ice against the surface 77, through the compression zone 74 appear as $F_{n1}$, $F_{n2}$, $F_{n3}$, $F_{n4}$, $F_{n5}$, $F_{n6}$, $F_{n7}$ and $F_8$. In each case of the various points 1–8 along the surface 77 of the nozzle 66, the force diagram represented by a substantially longitudinal leg Fe and one of the normal legs $F_{n1}$–$F_{n8}$, define an acute angle therebetween $b_1$ though $b_8$, although only angles $b_1$ and $b_8$ are shown in the drawing. The compressive force $F_c$ on the ice as it is passing through the zone 74 of the nozzle 66, in each case is defined as $F_e \div$tangent of angle b, to yield compressive force components as the ice passes through the zone 74 as $F_{cl}$, $F_{c2}$, $F_{c3}$, $F_{c4}$, $F_{c5}$, $F_{c6}$, $F_{c7}$ and $F_{c8}$ at the eight points appearing on FIG. 5, to define a compression force gradient that is essentially parabolic in nature, which progress higher logarithmically from inlet to outlet as shown by the imaginary line 78 in FIG. 5.

Thus, with the nozzle configuration of FIGS. 4 and 5, for the surface 77, eventually relatively higher compression forces are reached as one approaches the outlet of the zone 74, for example, at the locations shown in FIG. 5 for compression forces $F_6$, $F_7$ and $F_8$.

Figure 7:
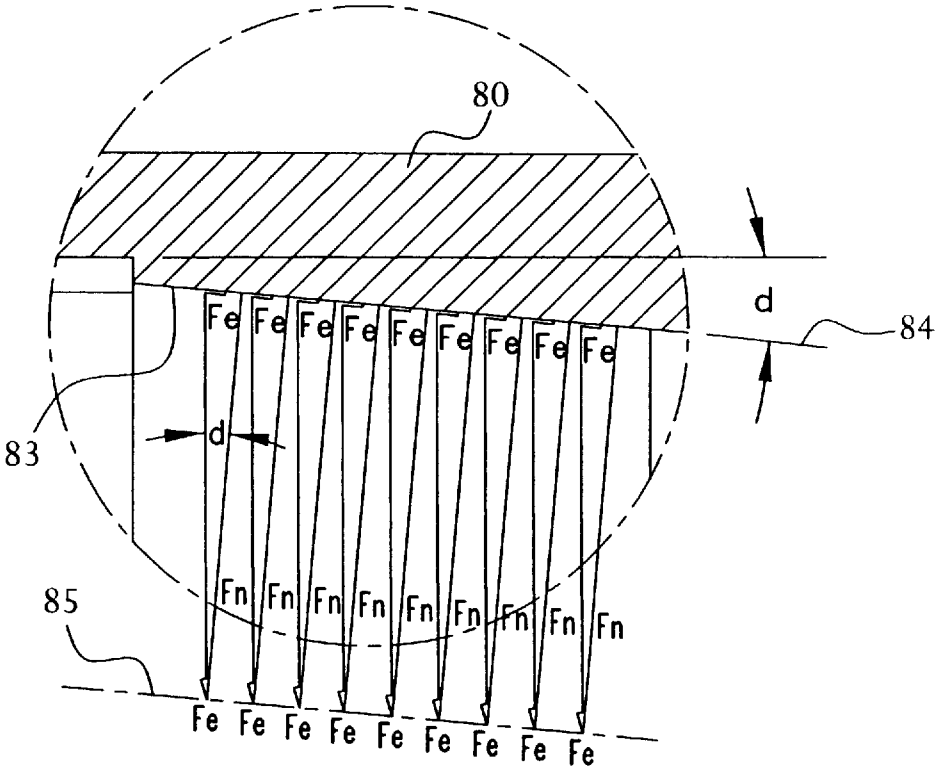
FIG. 7 PRIOR ART
FIG. 7 is a view analogous to that of FIG. 5, showing force distribution lines of the prior art nozzle of FIG. 6, in the area of detail 7 of FIG. 6.
Figure 6:
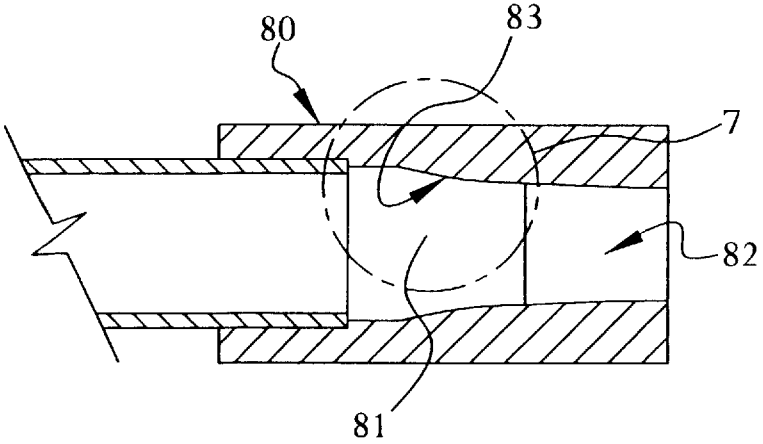
FIG. 6 PRIOR ART
FIG. 6 is a view like that of FIG. 4, taken through a prior art nozzle.

With reference to FIGS. 6 and 7, a comparison of the results of the nozzle configuration of FIGS. 4 and 5 with the prior art configuration of FIGS. 6 and 7, will be apparent.

In the prior art illustration of FIG. 6, a nozzle 80 is illustrated, having a compression zone 81 and an out let 82. The surface of revolution 83 of the compression zone 81, is defined as being truly frusto-conical, such that a line 84 drawn extending from the surface as shown in FIG. 7, would be a straight line. The compression force gradient of FIG. 7 shows that, with essentially the same extrusion force reaction $F_e$, as for the nozzle of FIGS. 4 and 5, the normal forces $F_n$ are substantially less than that shown for the gradient of FIG. 5, such that, when the compressive force component $F_c$ is measured by the formula $F_c = F_c \div$tangent of angle d, the compression forces $F_c$ increase essentially linearly, as shown by the phantom line 85, to reach illustrative levels not approaching that shown in FIG. 5 for the nozzle 66 of the present invention.

After ice leaves the nozzle 66, one or more bends 90 in the delivery line 12, break the column of ice compressed in the nozzle 66, into a plurality of nuggets, to be delivered serially, to the ice retaining means 14, possibly at a location that is remote from that of the ice generating apparatus 10.

It will be recognized by those skilled in the art that changes may be made in the above-described embodiments of the invention, without departing from the broad inventive concepts thereof. It is understood, therefore, that this invention is not limited to the particular embodiments disclosed, but is intended to cover all modifications which are within the spirit and scope of the invention as defined by the appended claims.

What is claimed is:

1. An ice making apparatus comprising (a) a freezing chamber with a generally cylindrical inner wall;

(b) a compacting head associated with said freezing chamber;

(c) a rotatable ice auger sized to fit said freezing chamber and comprising means for scraping ice formed on the wall of said chamber and conveying said ice to said compacting head;

(d) a means to cause rotation of said ice auger;

(c) a means for supplying water to said freezing chamber;

(f) a refrigeration means for cooling said freezing chamber;

(g) a means to discharge ice from said compacting head;

(h) wherein said means to discharge ice from said compacting head includes a discharge nozzle;

(i) wherein said discharge nozzle has an ice inlet and an ice outlet and has a compression zone for compressing ice and squeezing water therefrom, with said compression zone being defined by a surface of revolution that is arcuately convex and convergent from inlet to outlet; and (j) wherein said nozzle includes a water-receiving canal located in for receiving water squeezed from the ice.

2. The ice making apparatus of claim 1, wherein said canal comprises an annular pocket in said nozzle.

3. The ice making apparatus of claim 1, wherein said canal has a water discharge port for discharging water squeezed from the ice, out of the nozzle.

4. The ice making apparatus of claim 3, including an air vent for the canal for facilitating water flow from said canal.

5. The ice making apparatus of claim 3, wherein said canal comprises an annular pocket in said nozzle.

6. The ice making apparatus of claim 4, wherein said canal comprises an annular pocket in said nozzle.

7. The ice making apparatus of claim 1, wherein said surface of revolution is a frustum of a radius-defined convex conical passageway.

8. The ice making apparatus of any one of claims 3–6, including means associated with the apparatus for breaking up the ice into a plurality of nuggets after the ice leaves the discharge nozzle.

9. The ice making apparatus of claim 1, wherein said surface of revolution is a frustum of a radius-defined convex conical passageway, including means associated with the apparatus for breaking up the ice into a plurality of nuggets after the ice leaves the discharge nozzle.

10. The ice making apparatus of claim 1, wherein the compression zone creates a compression force gradient that is progressively higher logarithmically from inlet to outlet of nozzle for squeezing water from the ice.

11. The ice making apparatus of claim 10, wherein the shape of the nozzle from inlet to outlet creates a compression gradient that is logarithmic in nature for squeezing water from the ice.

12. The ice making apparatus of claim 1, wherein the compression zone creates a compression force gradient that is parabolic in nature from inlet to outlet of nozzle for squeezing water from the ice.

13. The ice making apparatus of claim 12, wherein the shape of the nozzle from inlet to outlet creates a compression gradient that is parabolic in nature for squeezing water from the ice.

* * * * *